US011437759B2

(12) United States Patent
Hitchcock et al.

(10) Patent No.: US 11,437,759 B2
(45) Date of Patent: Sep. 6, 2022

(54) COAXIAL CONNECTOR ASSEMBLY WITH ALIGNMENT MEMBER

(71) Applicant: TE Connectivity Services GmbH, Schaffhausen (CH)

(72) Inventors: Matthew Bryan Hitchcock, Hershey, PA (US); Rakesh Yarlagadda, Kernersville, NC (US)

(73) Assignee: TE Connectivity Services GmbH

( * ) Notice: Subject to any disclaimer, the term of this patent is extended or adjusted under 35 U.S.C. 154(b) by 0 days.

(21) Appl. No.: 17/127,005

(22) Filed: Dec. 18, 2020

(65) Prior Publication Data

US 2022/0200204 A1 Jun. 23, 2022

(51) Int. Cl.

| | |
|---|---|
| ***H01R 13/631*** | (2006.01) |
| ***H01R 27/02*** | (2006.01) |
| ***H01R 13/627*** | (2006.01) |
| ***H01R 24/38*** | (2011.01) |
| ***H01R 103/00*** | (2006.01) |

(52) U.S. Cl.

CPC ..... *H01R 13/631* (2013.01); *H01R 13/6272* (2013.01); *H01R 13/6275* (2013.01); *H01R 24/38* (2013.01); *H01R 27/02* (2013.01); *H01R 2103/00* (2013.01)

(58) Field of Classification Search

CPC ..... H01R 13/6272; H01R 13/6275; H01R 13/631; H01R 24/38; H01R 27/02; H01R 2103/00

See application file for complete search history.

(56) References Cited

U.S. PATENT DOCUMENTS

| | | | |
|---|---|---|---|
| 5,501,606 | A | 3/1996 | Oda et al. |
| 6,305,990 | B1 | 10/2001 | Ward |
| 8,075,351 | B2 | 12/2011 | Park et al. |
| 9,337,577 | B1 | 5/2016 | Hitchcock et al. |
| 10,312,626 | B2 | 6/2019 | Vasbinder et al. |
| 2017/0170611 | A1* | 6/2017 | Yi ..... H01R 13/6315 |
| 2021/0066850 | A1 | 3/2021 | Tanimura et al. |
| 2022/0109262 | A1 | 4/2022 | Sundarakrishnamachari et al. |

OTHER PUBLICATIONS

GB Search Report, Application No. GB 2118553.3 dated May 25, 2022.

* cited by examiner

*Primary Examiner* — Oscar C Jimenez

(57) ABSTRACT

An alignment device for use in an electrical connector or electrical connector assembly having coaxial terminals. The alignment device includes a planar plate portion having a first wall and an oppositely facing second wall. A plurality of coaxial terminal receiving openings extend through the plate portion. The coaxial terminal receiving openings are configured to receive mating ends of the coaxial terminals. Alignment members extend from the second wall of the plate portion in a direction away from the first wall, the alignment members are positioned proximate the coaxial terminal receiving openings.

17 Claims, 12 Drawing Sheets

COAXIAL CONNECTOR ASSEMBLY WITH ALIGNMENT MEMBER

FIELD OF THE INVENTION

The present invention is directed to an electrical connector assembly with a hybrid pin field which includes coaxial terminals. In particular, the invention is directed to an alignment device which cooperates and supports different types of electrical terminals, including coaxial terminals.

BACKGROUND OF THE INVENTION

Electrical connectors may be used to transfer data and/or electrical power between different systems or devices. Electrical connectors are often designed to operate in challenging environments where contaminants, shock and/or vibration can disrupt the electrical connection. For example, automobiles and other machinery utilize electrical connectors to communicate data and/or electrical power therein. At least some known electrical connectors include a connector housing that has a cavity configured to receive another electrical connector (hereinafter referred to as a "mating connector"). The cavity opens to a front end of the connector housing and extends a depth into the connector housing. The electrical connector includes an array of electrical contacts, and the mating connector includes a complementary array of electrical contacts (hereinafter referred to as "mating contacts"). As the mating connector is received within the cavity, the electrical contacts are received within corresponding socket openings of the mating connector. Each socket opening may include one of the mating contacts that engages the corresponding electrical contact to establish an electrical connection.

Many times, harnesses must be assembled and/or preassembled, where one part of the connector is not mated with the corresponding connector until sometime further in the overall assembly process. Thus, this requires a great deal of care for socket connectors of the type having a header and a plurality of upstanding tabs and/or pins.

Although the connector housing partially surrounds the electrical contacts within the receiving cavity, the electrical contacts may be exposed to the ambient environment through the open front end. During shipping or handling of the electrical connectors, contaminants may enter the receiving cavity through the front end. In addition, the front end may permit objects to enter the receiving cavity and engage the electrical contacts thereby moving and/or bending the electrical contacts. If an electrical contact is not positioned properly within the receiving cavity, the electrical contact may improperly engage the mating connector, an incident referred to as stubbing, which can damage the electrical contact. In some cases, the damage may require the electrical contact or, potentially, the entire electrical connector to be replaced. In addition, the use of alignment plates may facilitate the positioning of the terminals, but are often difficult to use with sealed connectors, as the clearance required for the movement of the alignment plates prevents proper sealing of the connector.

Such electrical connectors generally do not include coaxial terminals, as hybrid pin fields are often difficult to support and to mate, causing the coaxial terminals to be damaged during shipping, handling or mating. Consequently, coaxial terminals are often mated in assemblies which are independent from the electrical connectors.

Accordingly, there is a need for an electrical connector assembly with a hybrid pin field which includes coaxial terminals. In addition, there is a need to have hybrid pin field with a pin protection plate that provides alignment and protection prior to the outer contacts engaging, whether with sealed or unsealed connector assemblies.

SUMMARY OF THE INVENTION

An embodiment is directed to an alignment device for use in an electrical connector having coaxial terminals. The alignment device includes a planar plate portion having a first wall and an oppositely facing second wall. A plurality of coaxial terminal receiving openings extend through the plate portion. The coaxial terminal receiving openings are configured to receive mating ends of the coaxial terminals. Alignment members extend from the second wall of the plate portion in a direction away from the first wall, the alignment members are positioned proximate the coaxial terminal receiving openings.

An embodiment is directed to an electrical connector having a housing with a mating surface. Coaxial terminals extend through the housing, the coaxial terminals have free ends which are spaced from the mating surface. A terminal alignment device has a planar plate portion having a first wall and an oppositely facing second wall. A plurality of coaxial terminal receiving openings extend through the plate portion. The coaxial terminal receiving openings are configured to receive the free ends of the coaxial terminals. Alignment members extend from the second wall of the plate portion in a direction away from the first wall. The alignment members are positioned proximate the coaxial terminal receiving openings. The terminal alignment member is movable between a first position in which the plate portion is spaced from the mating surface of the housing to a second position in which the plate portion is positioned proximate to the mating portion.

An embodiment is directed to an electrical connector assembly which has a first connector and a second connector. The first connector includes a first housing having a first mating surface. First coaxial terminals with free ends which are spaced from the first mating surface. A terminal alignment device has a planar plate portion with a first wall and an oppositely facing second wall. A plurality of first coaxial terminal receiving openings extend through the plate portion. Coax alignment members extend from the second wall of the plate portion in a direction away from the first wall. The coax alignment members are positioned proximate the first coaxial terminal receiving openings. The second connector includes a second housing with a second mating surface and second coaxial terminals. A terminal position assurance member is provided proximate the second mating face. The terminal position assurance member has coax alignment member receiving recesses positioned proximate second coaxial terminal receiving openings. The coax alignment member receiving recesses are positioned to cooperate with the coax alignment members of the plate portion of the alignment device. As the second connector is mated to the first connector, the terminal alignment device is movable between a first position in which the plate portion is spaced from the mating surface of the housing to a second position in which the plate portion is positioned proximate to the mating portion.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
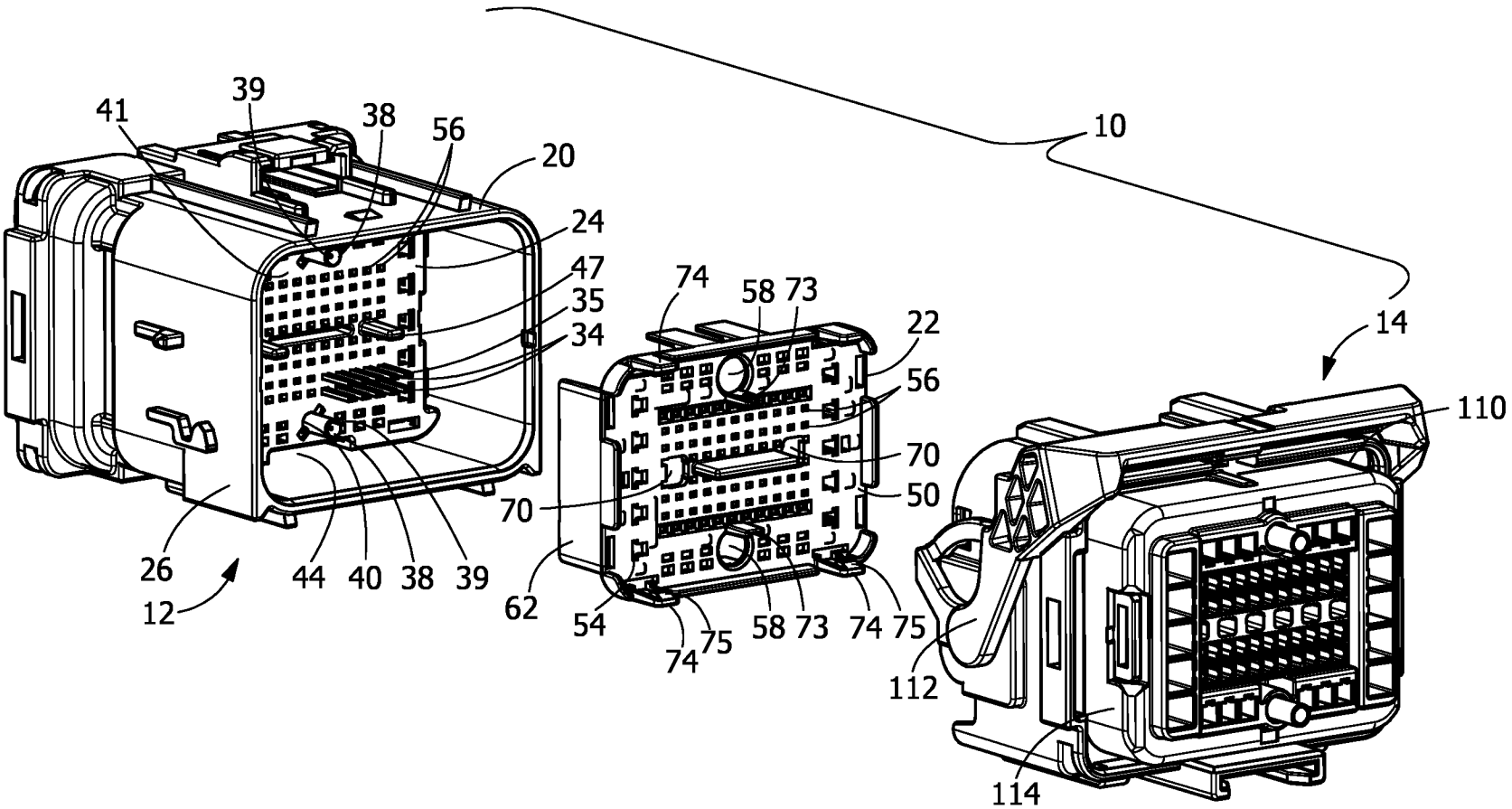
FIG. 1 is a front perspective view of a male connector of an electrical connector assembly of the present invention prior to mating with a female connector of the connector assembly, a pin alignment device is exploded from the male connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, the electrical connector assembly 10 includes a male connector or header assembly 12 and a female or mating connector 14 which is configured to mechanically and electrically mate to the male connector 12.

The male connector 12 has a housing 20 and a movable pin or terminal alignment device or plate 22. The housing 20 includes a terminal receiving portion 24 with a shroud 26 extending therefrom.

The male connector 12 includes a hybrid pin field. Contacts or terminals 34 (FIG. 1) extend through terminal receiving openings 36 of the terminal receiving portion 24 of the housing 20. The contacts or terminals 34 may be pin contacts, tabs or other known types of terminals. The terminals 34 have mating or distal ends 35. Coaxial contacts or terminals 38 extend through terminal receiving openings 40 of the terminal receiving portion 24 of the housing 20. The terminals 38 have mating or distal ends 39. For ease of viewing and understanding, only several terminals 34 are shown in FIG. 1 and the terminals 34 are not shown in remaining figures.

Figure 4:
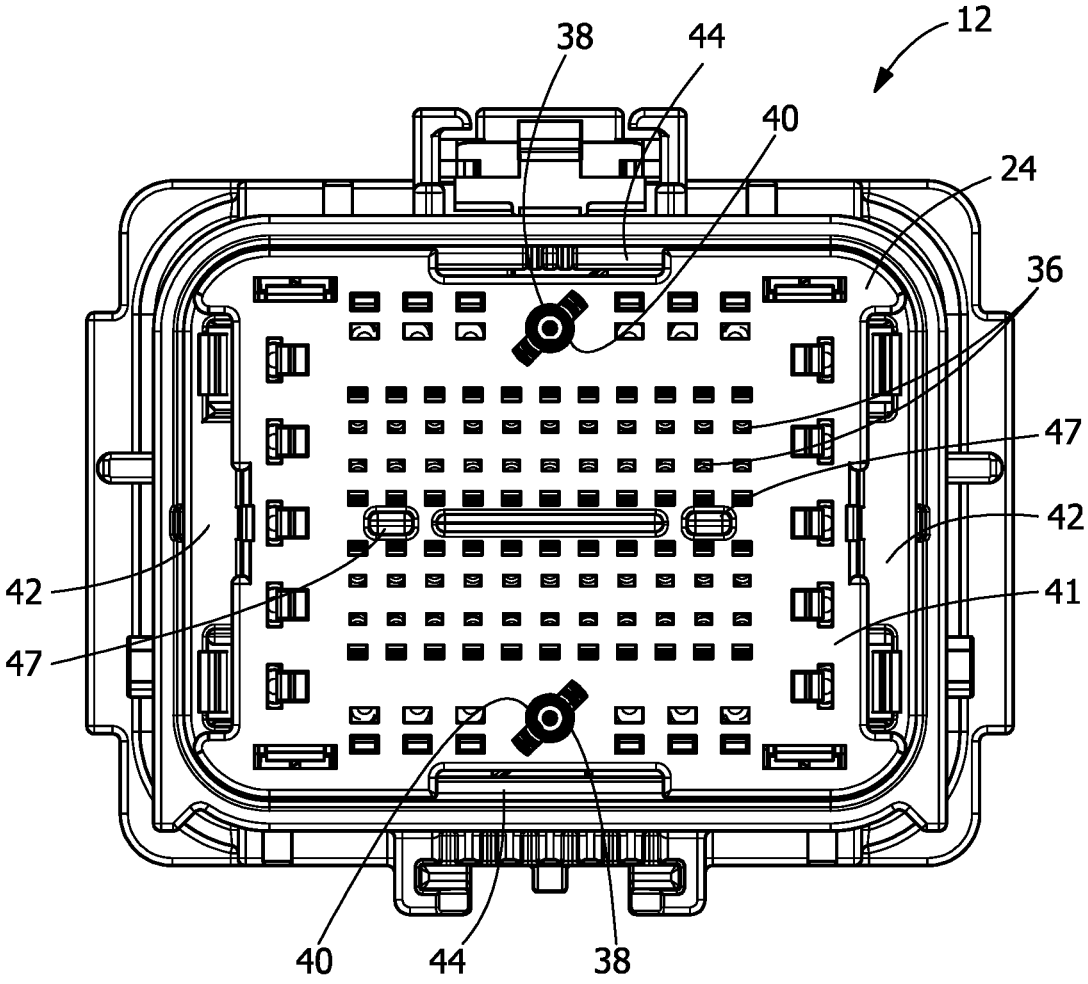
FIG. 4 is a front view of the male connector of FIG. 1, with the alignment device removed.
Figure 5:
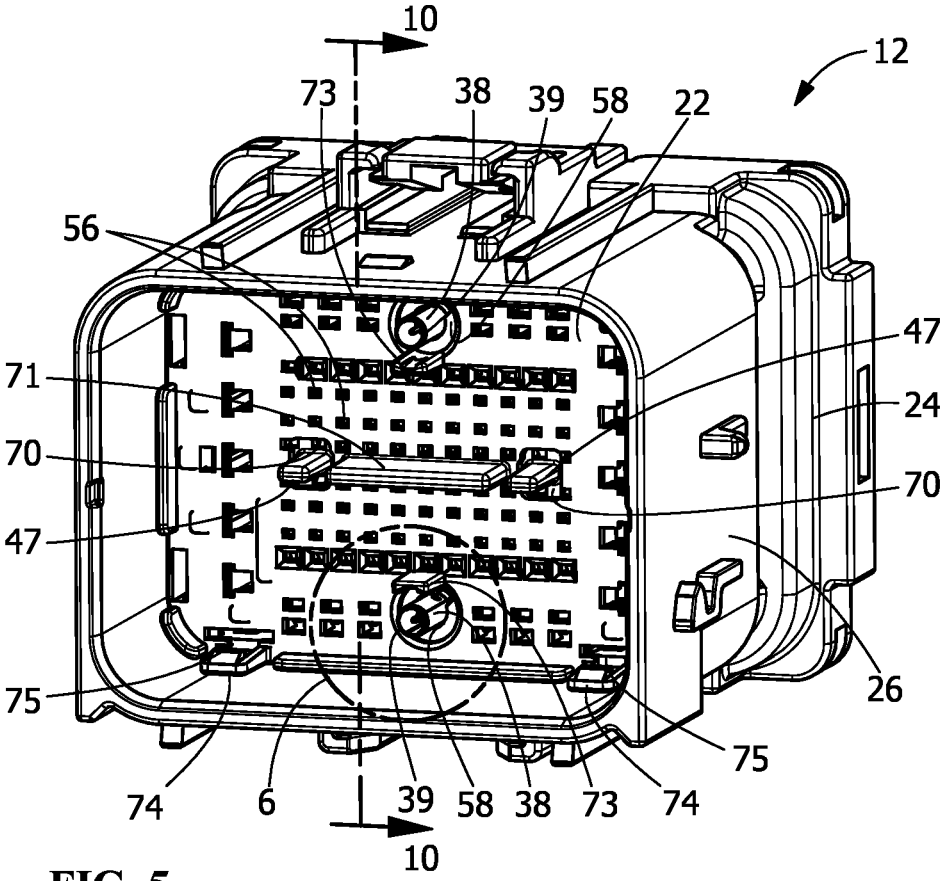
FIG. 5 is a perspective view of a mating end of the male connector with the alignment device in an initial position.
Figure 12:
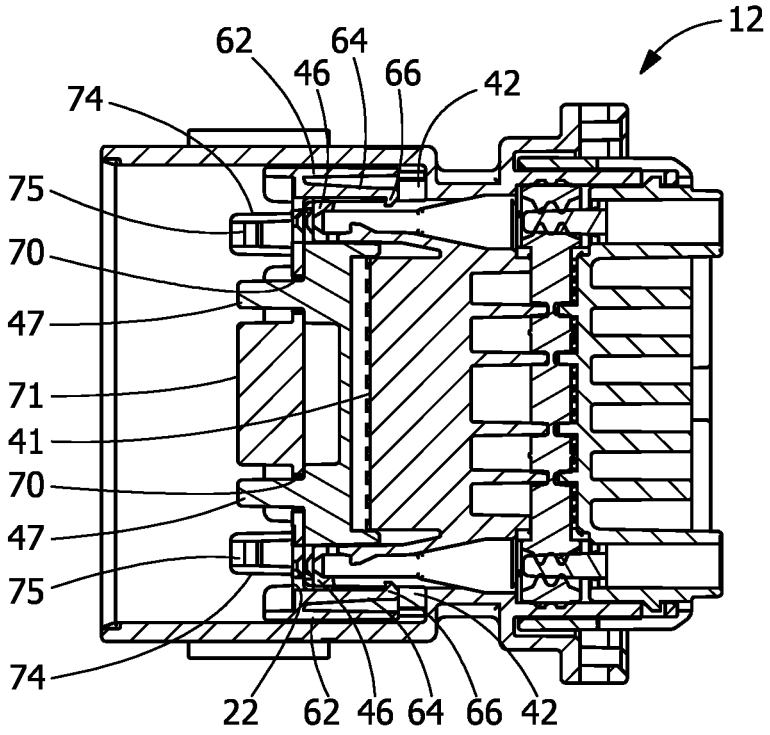
FIG. 12 is a cross sectional view of the male connector prior to mating, similar to FIG. 10, showing the alignment device in a second or final position.

As shown in FIG. 4, the terminal receiving portion 24 has first alignment member receiving recesses 42 and second alignment member receiving recesses 44. The recesses 42, 44 extend from a mating face 41 of the terminal receiving portion 24 through at least a portion of the terminal receiving portion 24. The first alignment member receiving recesses 42 have retaining shoulders 46 (FIGS. 10 and 12) positioned therein.

Alignment posts 47 extend from the mating face 41 of the terminal receiving portion 24. In the illustrative embodiment shown, two alignment posts 47 are provided. Other configurations and numbers of alignment posts 47 may be provided.

The shroud 26 extends from the terminal receiving portion 24. The shroud 26 is dimensioned to extend higher from the mating face 41 than the terminals 34, 38 to provide protection to the terminals 34, 38 prior to the male connector 12 being mated to the female connector 14.

Figure 2:
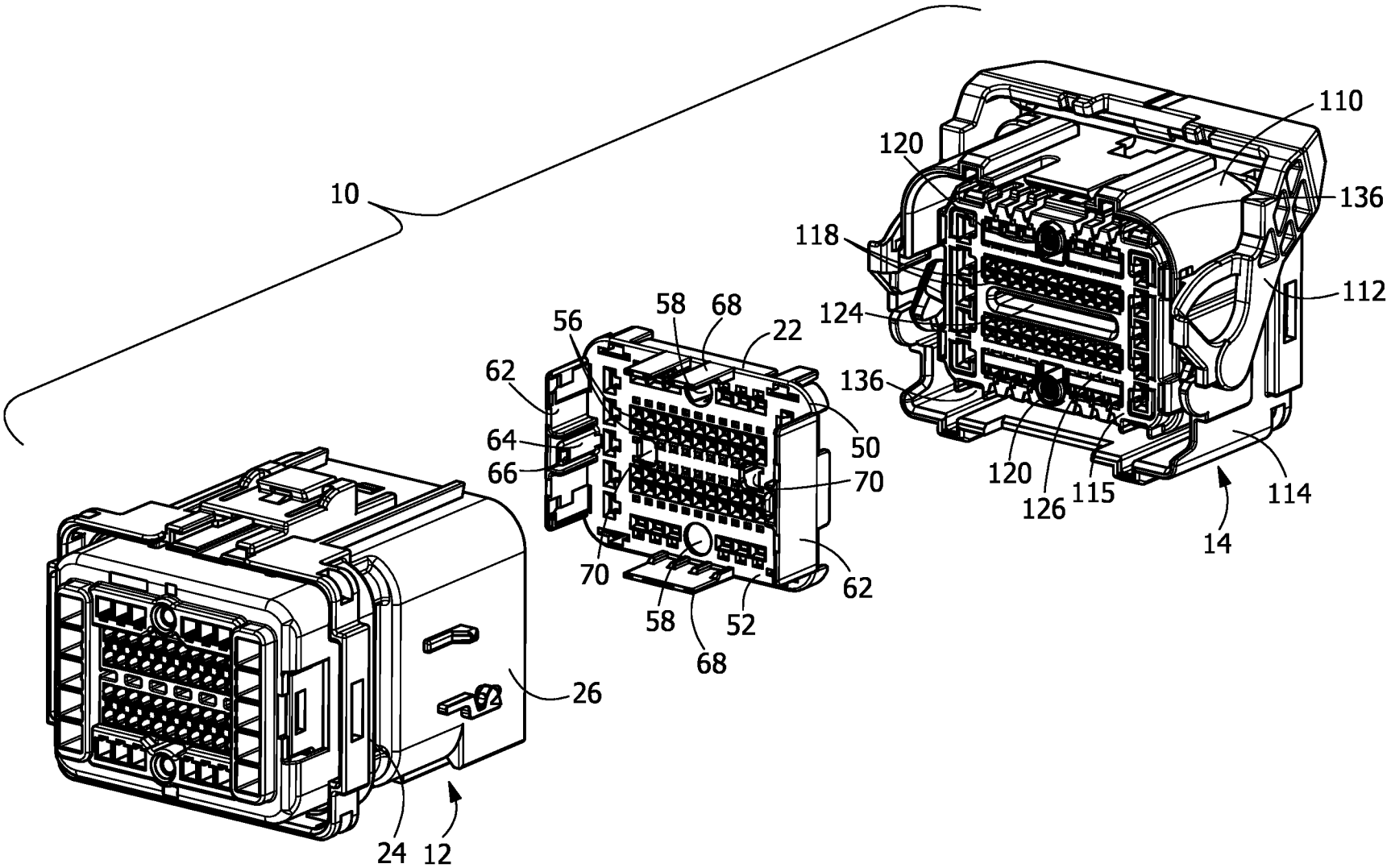
FIG. 2 is a back perspective view of the male connector of the electrical connector assembly of the present invention prior to mating with the female connector of the connector assembly, the pin alignment device is exploded from the male connector.
Figure 3:
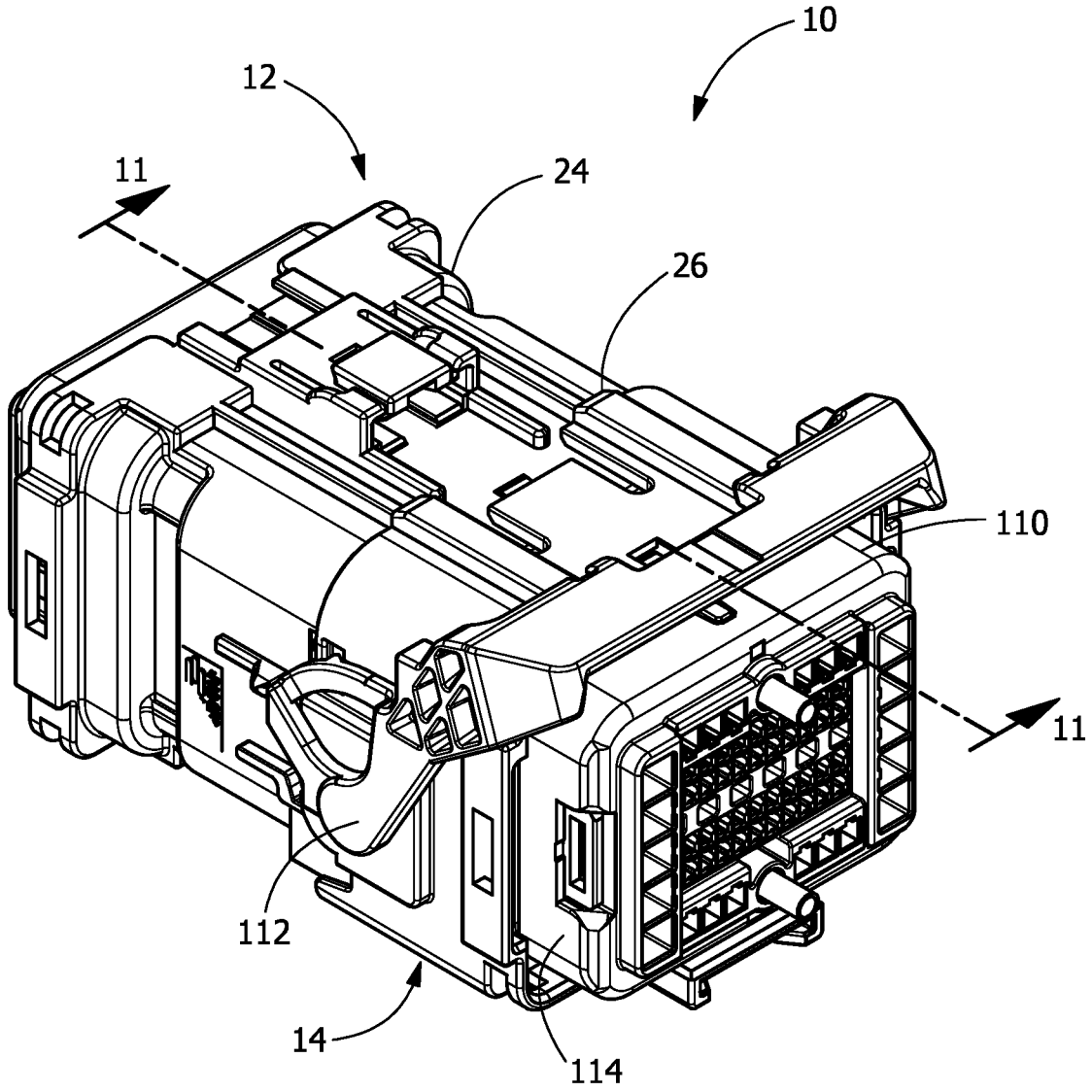
FIG. 3 is a perspective view of the male connector and female connector mated together.

As shown in FIGS. 1 and 2, the alignment device 22 includes a planar plate portion 50 with a first wall 52 and an oppositely facing second wall 54. A plurality of terminal receiving openings 56, 58 extend through the plate portion 50. The terminal receiving openings 56 are configured to receive mating ends of the terminals 34. The terminal receiving openings 58 are configured to receive the mating or distal ends 39 of the coaxial terminals 38.

First projections 62 extend from the first wall 52 of the plate portion 50 in a direction away from the second wall 54. The first projections 62 are provided at either end of the plate portions 50. As shown in FIG. 2, a resilient arm or latch 64 is provided proximate each first projection 62. The resilient latch 64 has a latching projection 66 provided at a free end thereof. Second projections 68 also extend from the first wall 52 of the plate portion 50 in a direction away from the second wall 54. The second projections 68 are provided on either side of the plate portion 50. The particular configuration and number of first projections 62 and second projections 68 may vary in different illustrative embodiments.

Alignment openings 70 extend through the plate portion 50. The alignment openings are configured and positioned to cooperate with the alignment posts 47. An alignment member 71 extends from the second wall 54 of the plate portion 50 in a direction away from the first wall 52. The alignment member 71 is positioned between the alignment openings 70. While the illustrative embodiment of the alignment members 71 are shown as tabs, other configurations, such as, but not limited to posts may be used.

Figure 8:
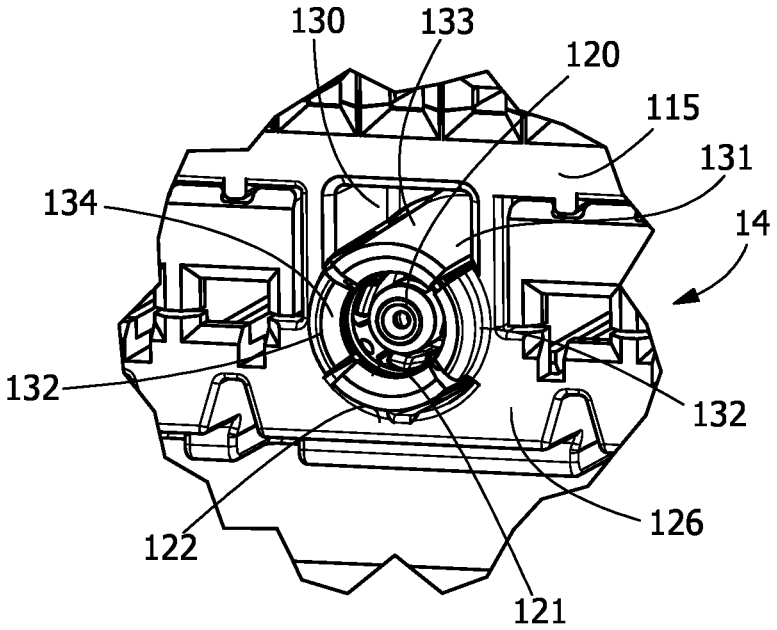
FIG. 8 is an enlarged perspective view of the area marked as 8 in FIG. 6.
Figure 9:
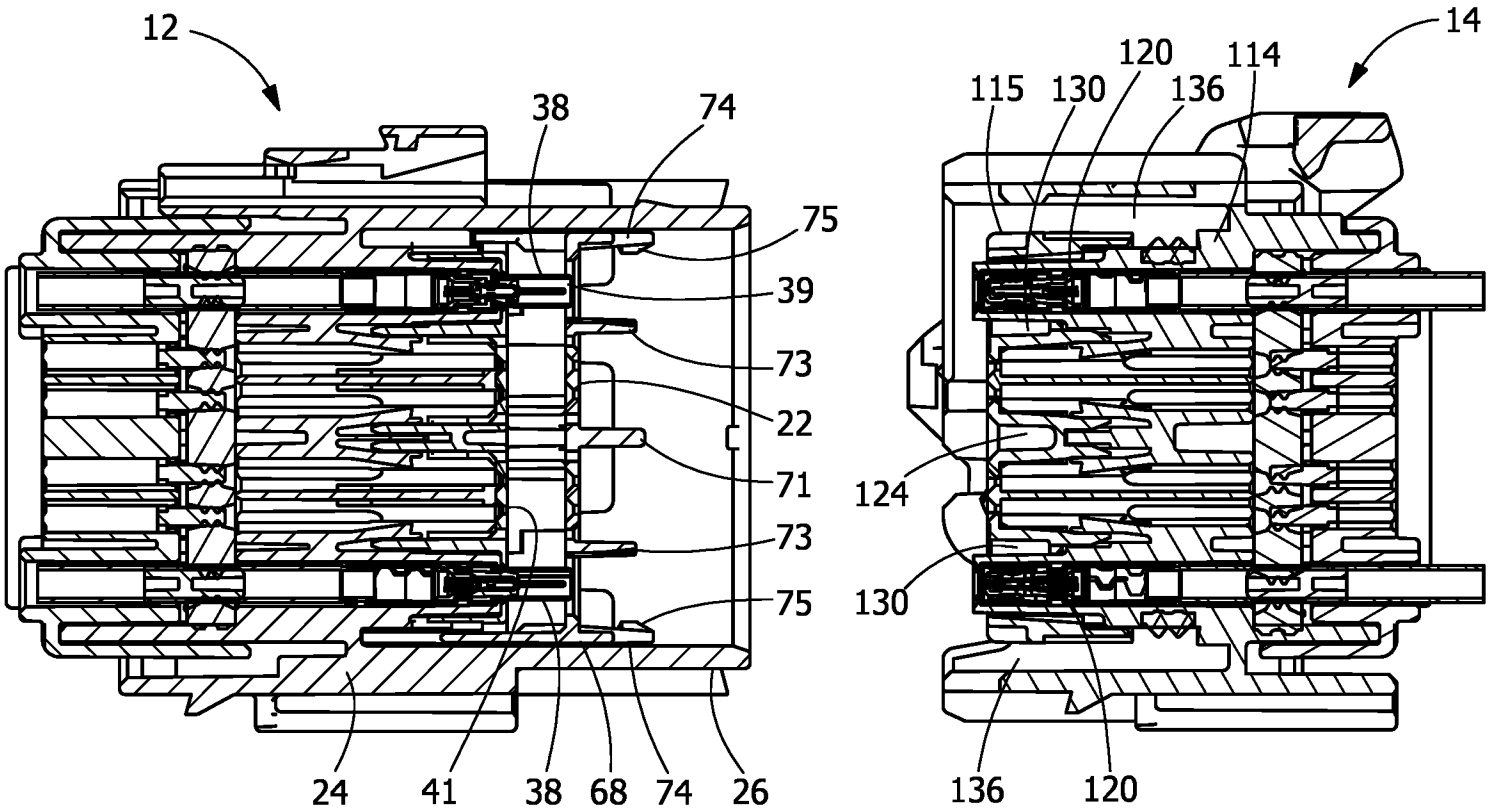
FIG. 9 is a cross sectional view of the male connector and the female connector prior to mating.

Coax alignment members 73 extend from the second wall 54 of the plate portion 50 in a direction away from the first wall 52. The coax alignment members 73 are positioned proximate the coaxial terminal receiving openings 58. As shown in FIG. 8, the coax alignment members 73 are dimensioned to extend beyond the end of the coaxial terminal 38 when the alignment device 22 is in the first or initial position. While the illustrative embodiment of the coax alignment members 73 are shown as tabs, other configurations, such as, but not limited to rings may be used.

Resilient arms 74 are spaced about the periphery of the plate portion 50 of the alignment device 22. The resilient arms 74 extend from the second wall 54 of the plate portion 50 in a direction away from the first wall 52. The resilient arms 74 have latching projections 75 provided at free ends thereof.

Figure 6:
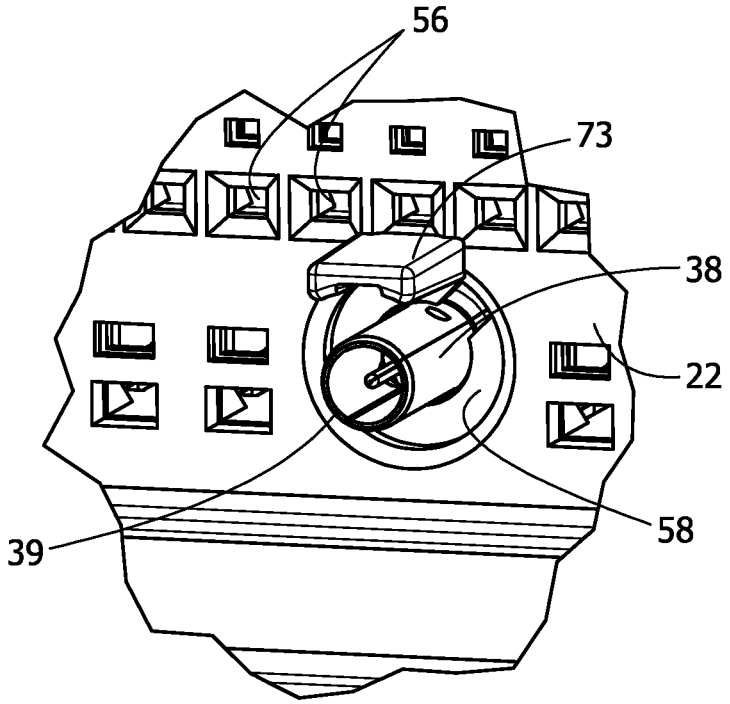
FIG. 6 is an enlarged perspective view of the area marked as 6 in FIG. 4.
Figure 7:
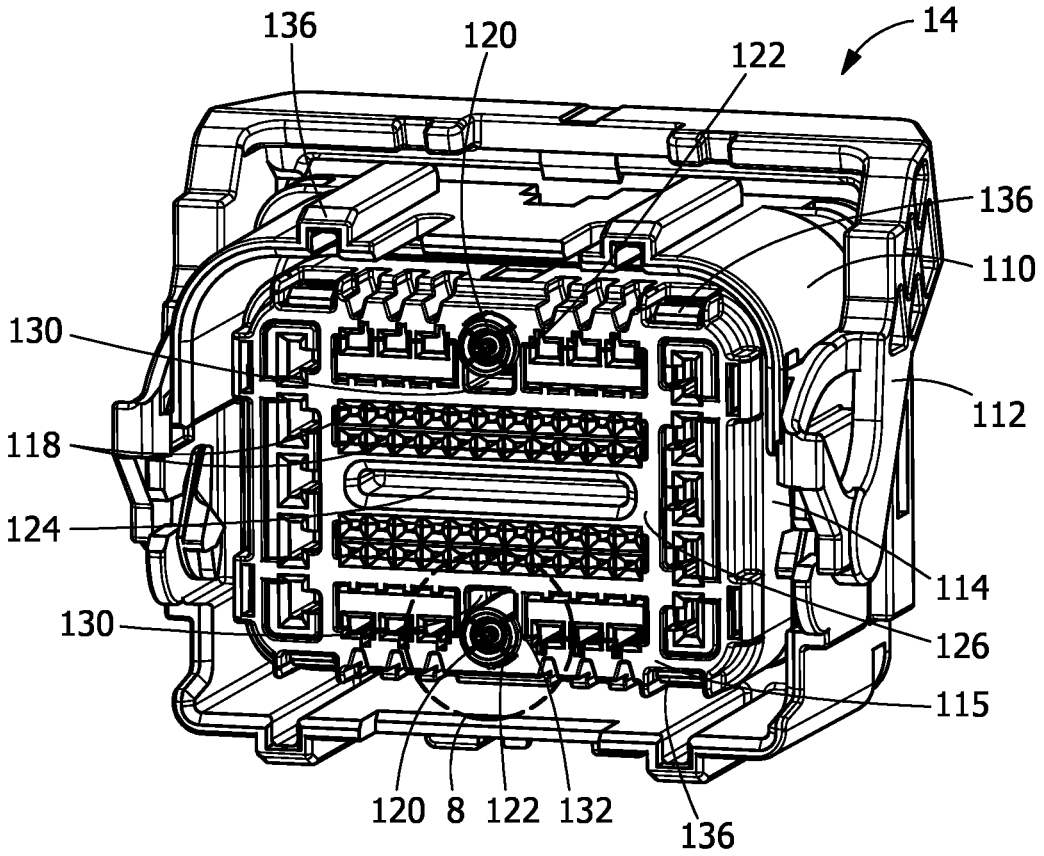
FIG. 7 is a perspective view of a mating end of the female connector.

As shown in FIGS. 6 and 7, the mating connector 14 has a housing 110 and a latching member 112. The housing 110 includes a terminal receiving portion 114. A terminal position assurance member 115 is provided on the terminal receiving portion 114.

The female or mating connector 14 includes a hybrid pin field. Contacts or terminals (not shown) extend through terminal receiving openings 118 of the terminal receiving portion 114 of the housing 110. The contacts or terminals may be receptable contacts or other known types of terminals. Coaxial contacts or terminals 120 extend through terminal receiving openings 122 of the terminal receiving portion 114 of the housing 110.

As shown in FIGS. 2, 6, 9 and 11, the terminal position assurance member 115 of the terminal receiving portion 114 has an alignment member receiving recess 124 which provided in a mating face 126 of the terminal position assurance member 115. The alignment member receiving recess 124 extends through the mating face 126 and through at least a portion of the terminal receiving portion 114. The alignment member receiving recess 124 is configured and positioned to cooperate with the alignment member 71 of the plate portion 50 of the alignment device 22 when the connector 12 and connector 14 are moved into engagement.

Coax alignment member receiving recesses 130 extend through the mating face 126 of the terminal position assurance member 115 and through at least a portion of the terminal receiving portion 114. The coax alignment member receiving recesses 130 are positioned proximate the coaxial terminal receiving openings 122.

The coax alignment member receiving recesses 130 are configured and positioned to cooperate with the coax alignment members 73 of the plate portion 50 of the alignment device 22 when the connector 12 and connector 14 are moved into engagement.

Positioning shoulders 132 (FIG. 8) of walls 131 extend from the mating face 126 of the terminal position assurance member 115. The positioning shoulders 132 engage ends 121 of the coaxial terminals 120 to retain the coaxial terminals 120 in position in the terminal receiving portion 114 of the connector 14. The positioning shoulders keep the coaxial terminals 120 centered in the terminal receiving openings 122 of the housing 110. The positioning shoulders 132 have lead in surfaces 134. The walls 131 have outside surfaces 133.

Resilient arms receiving recesses 136 are spaced about the periphery of the mating face 126 of the terminal position assurance member 115 of the terminal receiving portion 114. The resilient arms receiving recesses 136 are configured and positioned to cooperate with the resilient arms 74 of the plate portion 50 of the alignment device 22 when the connector 12 and connector 14 are moved into engagement.

Figure 10:
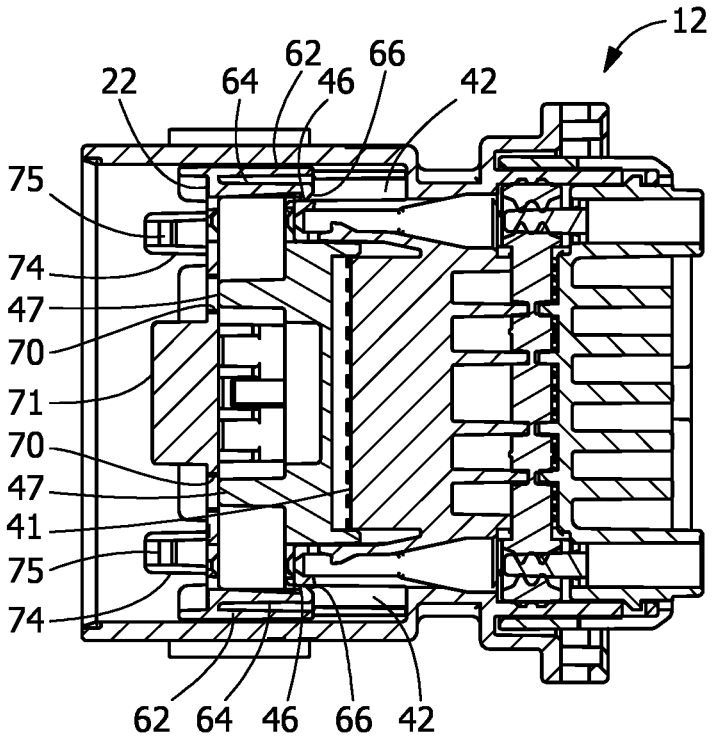
FIG. 10 is a cross sectional of the male connector prior to mating taken along line 10-10 of FIG. 6.

Referring to FIGS. 5, 9, 10 and 13, the alignment device 22 is shown in a first, protecting, pre-stage or shipping position. In this position, the plate portion 50 of the terminal alignment device 22 is positioned proximate the mating or distal ends 35 of the terminals 34 and the mating or distal ends 39 of the terminals 38. The first projections 62 are positioned in the first alignment member receiving recesses 42 to position the alignment device 22 relative to the terminal receiving portion 24, as shown in FIG. 10. In addition, the second projections 68 are provided in the second alignment member receiving recesses 44 to also facilitate positioning of the alignment device 22. In this position, the latching projections 66 of the resilient arms 64 engage the retaining shoulders 46 to prevent the removal of the alignment device 22 from the housing 20 of the connector 12.

In the first or protecting position, the plate portion 50 of the alignment device 22 is spaced from the terminal receiving portion 24 of the housing 20. This allows the plate portion 50 to be positioned nearer to the mating or distal ends 35 of the terminals 34 and the mating or distal ends 39 of the terminals 38 to provide structural support to the terminals 34 and the terminals 38. In so doing, the plate portion 50 of the alignment device 22 provides protection to the free ends of the terminals 34 and the terminals 38, preventing the terminals 34 and the terminals 38 from being deformed or damaged prior to the insertion of the mating connector 14 into the shroud 26 of the housing 20. For example, the alignment device 22 may shield the terminals 34 and the terminals 38 from objects that inadvertently enter the shroud 26. In some embodiments, the alignment device 22 may align and/or hold the terminals 34 and the terminals 38 in designated positions to reduce the likelihood of stubbing during the mating operation. Optionally, the alignment device 22 may be configured to function as a cover that reduces the likelihood of contaminants (e.g., dust) entering the shroud 26.

Figure 13:
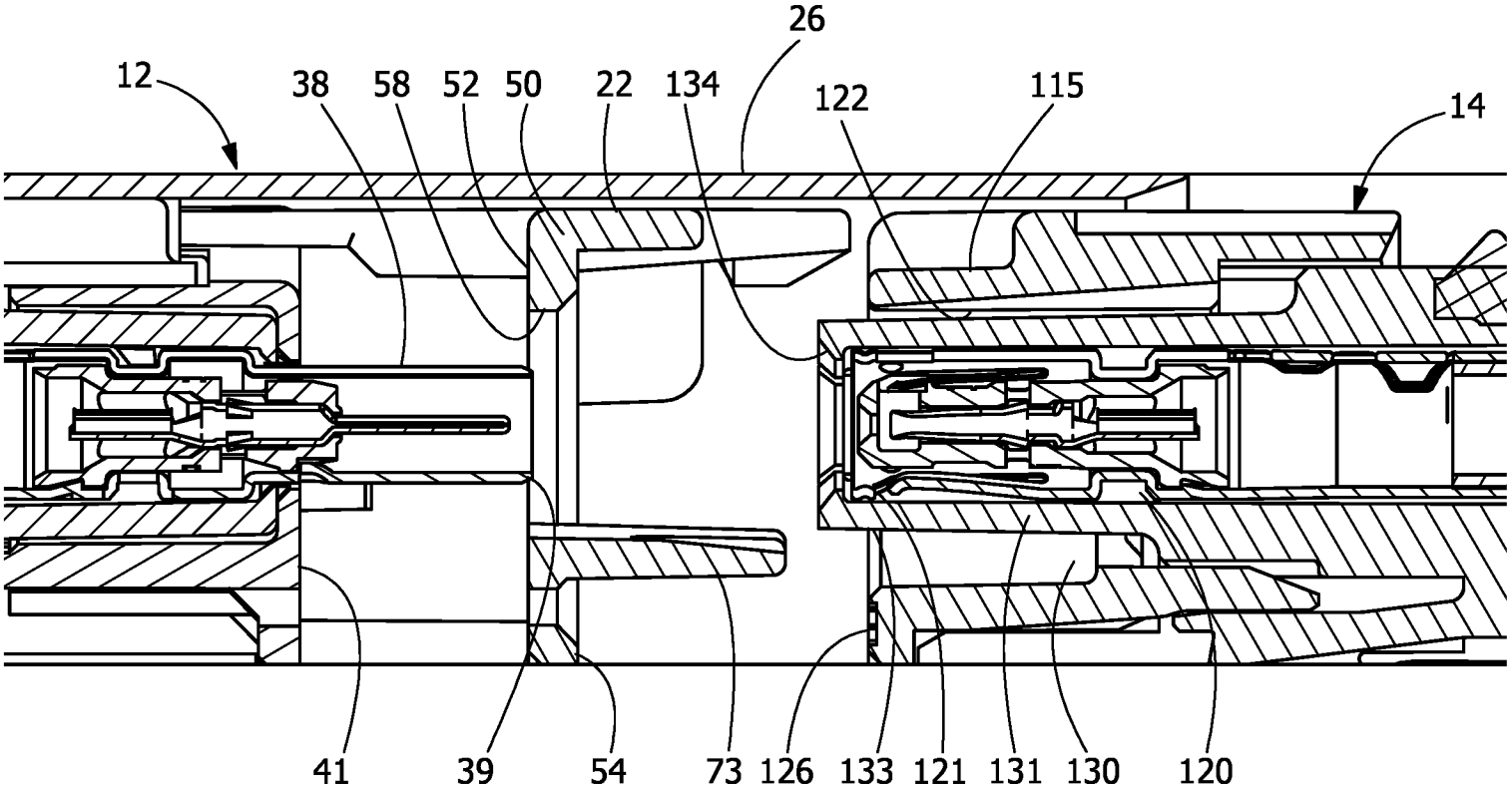
FIG. 13 is an enlarged cross sectional view of the coaxial portion of the male connector shown in FIG. 6 and the coaxial portion of the female connector shown in FIG. 8 just prior to mating.

Referring to FIG. 13, the alignment device 22 remains in the first, protecting, pre-stage or shipping position. In this position, the terminal receiving openings 38 of the plate portion 50 are in alignment with the free ends 39 of the coaxial terminals 38. Also, in this position, the coax alignment members 73 of the plate portion 50 extend further from the mating face 41 of the housing 20 than the free ends 39 of the terminals 38.

Figure 11:
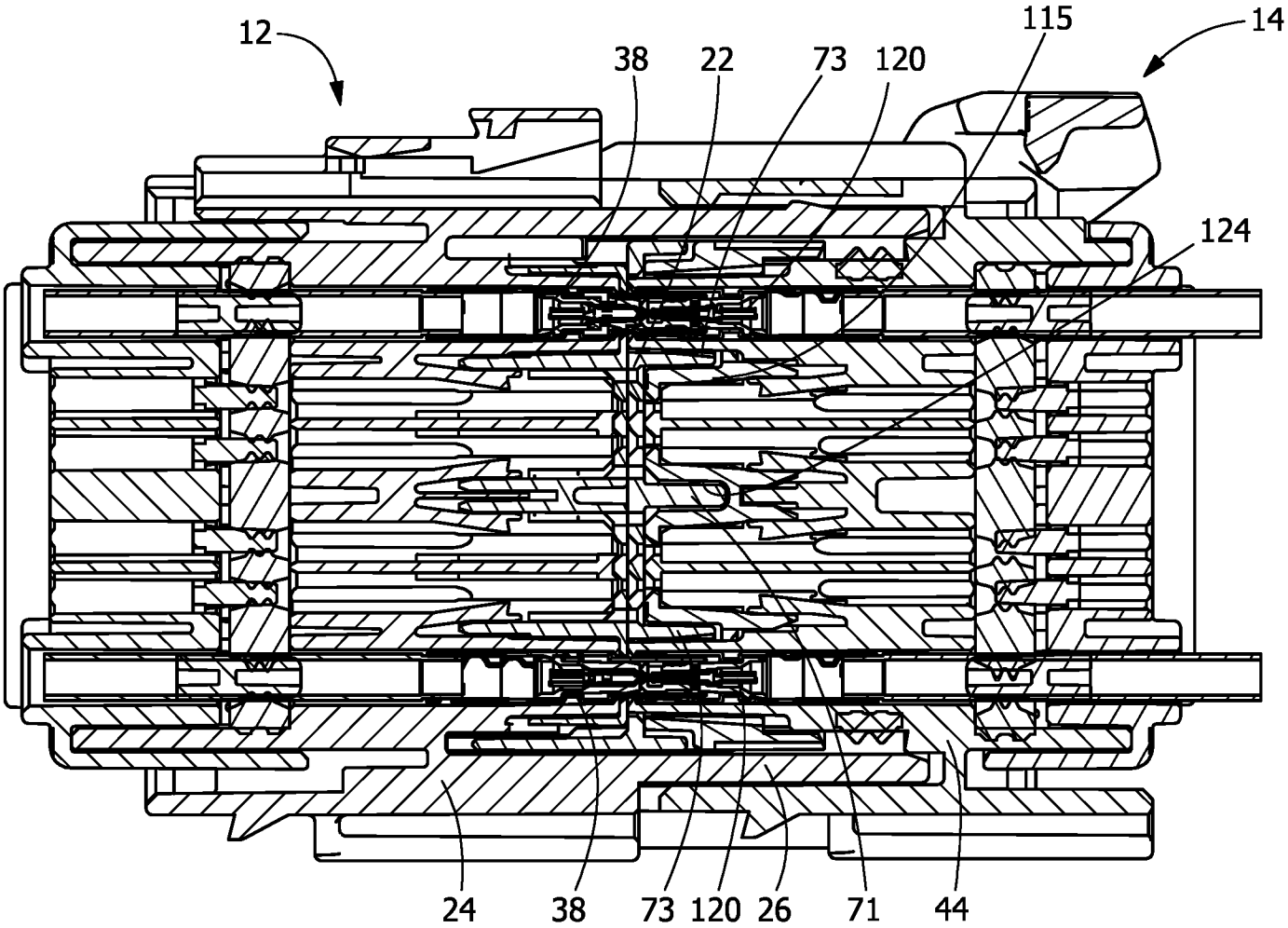
FIG. 11 is a cross sectional view of the male connector and the female connector, taken along line 11-1 of FIG. 2, showing the male connector fully mated to the female connector.
Figure 14:
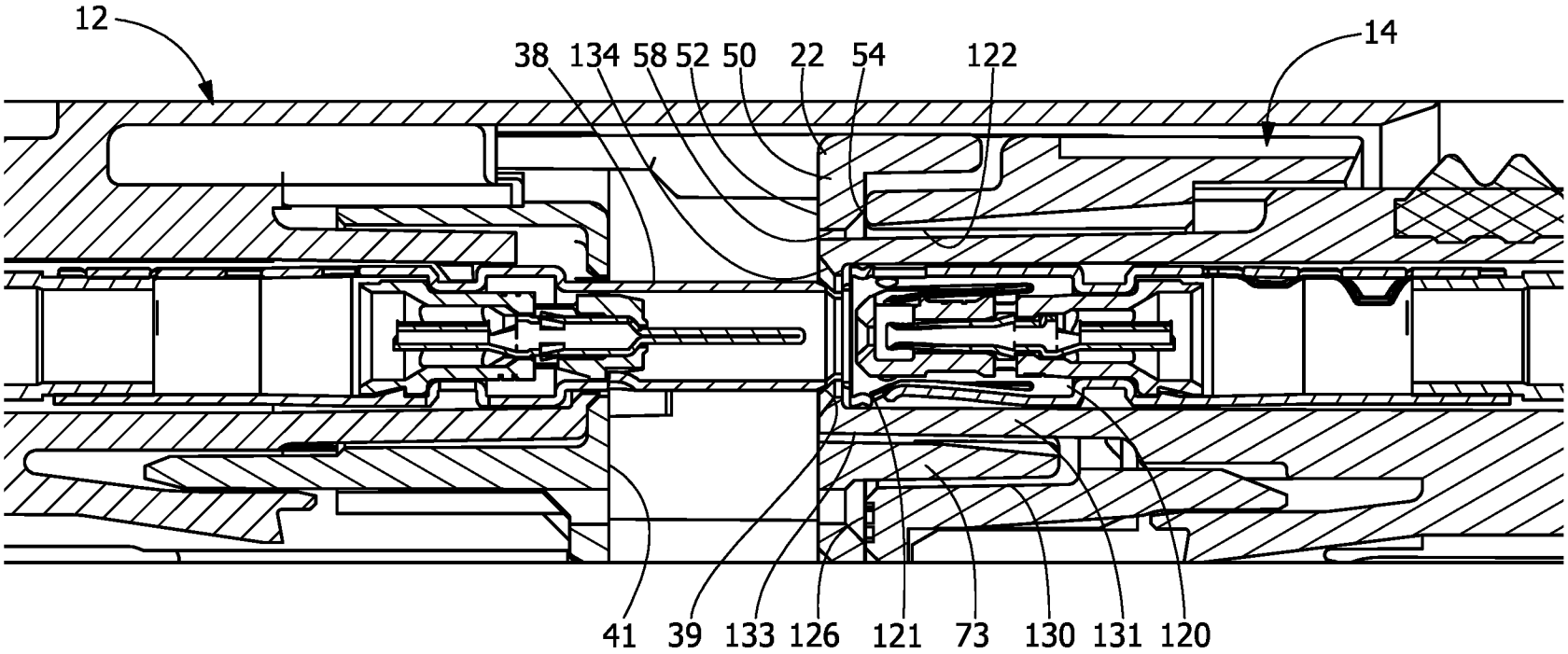
FIG. 14 is an enlarged cross sectional view similar to FIG. 13, showing the coaxial portion of the male connector shown in FIG. 8 and the coaxial portion of the female connector shown in FIG. 8 as mating occurs.
Figure 15:
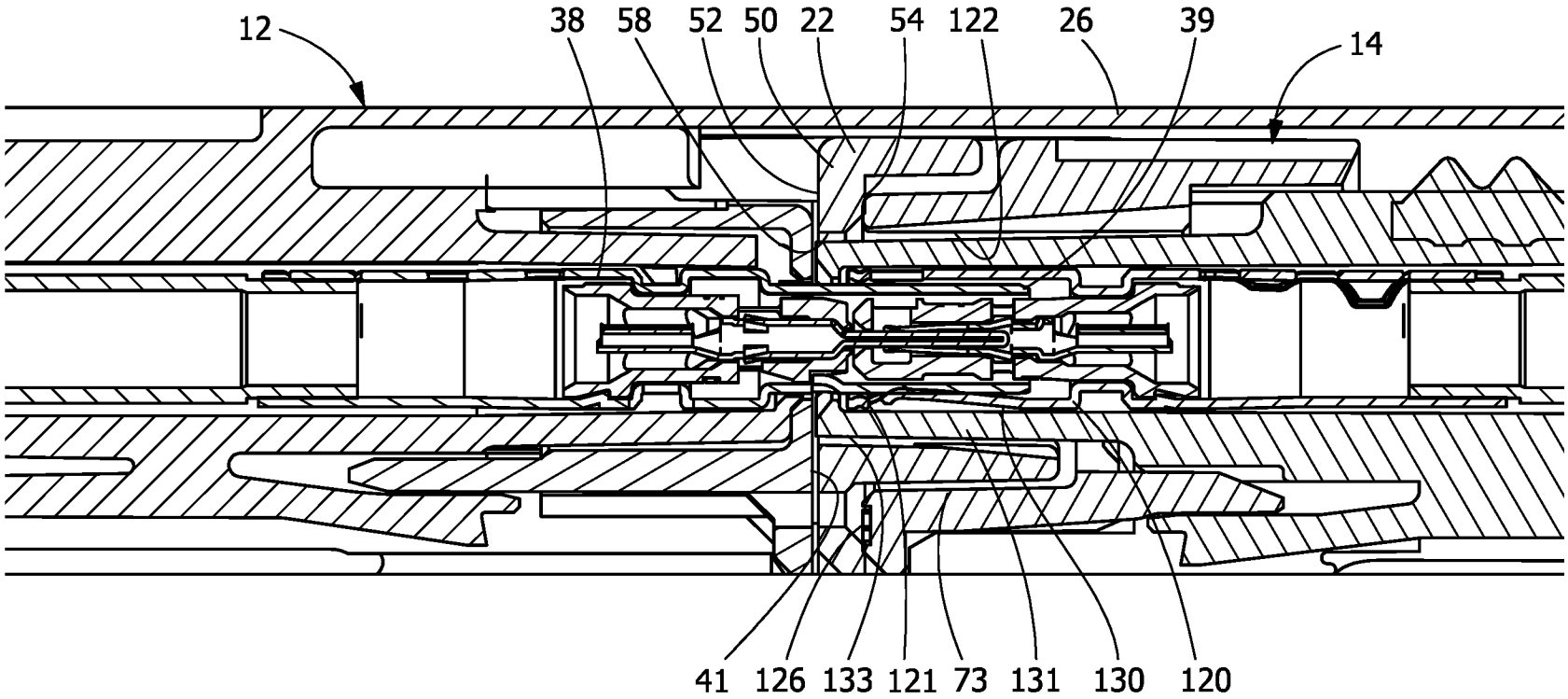
FIG. 15 is an enlarged cross sectional view similar to FIG. 13, showing the coaxial portion of the male connector shown in FIG. 6 and the coaxial portion of the female connector shown in FIG. 8 in the fully mated position.

As the mating connector 14 is brought into engagement with the connector 12, the mating face 126 of the terminal position assurance member 115 of the connector 14 is brought into engagement with the second wall 54 of the alignment device 22, as shown in FIG. 14. As this occurs, coax alignment members 73 of the plate portion 50 enters the coax alignment member receiving recesses 130. The cooperation of the coax alignment members 73 with the coax alignment member receiving recesses 130 properly positions the alignment device 22 with the terminal position assurance member 115 of the connector 14. In addition, the alignment member 71 enters the alignment member receiving recess 124 of the connector 14, as shown in FIG. 11 to facilitate the position of the alignment device 22 with the terminal position assurance member 115 of the connector 14.

As insertion of the mating connector 14 with the connector 12 continues, the terminal position assurance member 115 of the mating connector 14 engages the plate portion 50 of the alignment device 22 to move the plate portion 50 toward the mating face 41 of the terminal receiving portion 24 of the connector 12. As this occurs, side walls of the terminal receiving openings 58 the plate portion 50 of the alignment device 22 cooperate with the outside surfaces 133 of walls 131 to facilitate the positioning of the openings 58 and the mating or distal ends 39 of the coaxial terminals 38 relative to the coaxial terminals 120.

As insertion continues, the free ends 39 of the coaxial terminals 38 are moved past the plate portion 50 and engage the positioning shoulders 132 of the terminal position assurance member 115. The lead in surfaces 134 of the positioning shoulders 132 cause the free ends 39 of the coaxial terminals 38 to be centered relative to the coaxial terminals 120 of the mating connector 14. Consequently, as insertion continues, the coaxial terminals 38 of connector 12 and the coaxial terminals 120 and mating connector 14 are properly aligned, thereby preventing damage to the coaxial terminals 38 or the coaxial terminals 120 as the mating connector 14 is mated with the connector 12.

As the mating connector 14 and the connector 12 are mated, the terminals 34 of connector 12 are mated with the terminals (not shown) of the mating connector 14. As the mating of the terminals 34 of connector 12 with the terminals (not shown) of the mating connector 14 is known, a detailed description is not provided.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An alignment device for use in an electrical connector having coaxial terminals, the alignment device comprising:

a planar plate portion having a first wall and an oppositely facing second wall;

a plurality of coaxial terminal receiving openings extending through the plate portion, the coaxial terminal receiving openings being configured to receive mating ends of the coaxial terminals;

alignment members extending from the second wall of the plate portion in a direction away from the first wall, the alignment members positioned at the outer perimeter of the coaxial terminal receiving openings;

first projections extend from the first wall of the plate portion in a direction away from the second wall, the first projections are provided at either end of the plate portions, a resilient latch is provided proximate each first projection.

2. The alignment device as recited in claim 1, wherein the resilient latch has a latching projection provided at a free end thereof.

3. The alignment device as recited in claim 1, wherein second projections extend from the first wall of the plate portion in a direction away from the second wall, the second projections are provided on either side of the plate portion.

4. The alignment device as recited in claim 1, wherein alignment openings extend through the plate portion.

5. The alignment device as recited in claim 4, wherein an alignment tab extends from the second wall of the plate portion in a direction away from the first wall, the alignment tab is positioned between the alignment openings.

6. The alignment device as recited in claim 1, wherein resilient arms are spaced about the periphery of the plate portion of the alignment device, the resilient arms extend from the second wall of the plate portion in a direction away from the first wall.

7. The alignment device as recited in claim 6, wherein the resilient arms have latching members provided at free ends thereof.

8. An electrical connector comprising:

a housing having a terminal receiving portion and a mating surface, the terminal receiving portion having at least one alignment member receiving recess extending from the mating face through at least a portion of the terminal receiving portion;

coaxial terminals extending through the housing, the coaxial terminals having free ends which are spaced from the mating surface;

a terminal alignment device having a planar plate portion having a first wall and an oppositely facing second wall, a plurality of coaxial terminal receiving openings extending through the plate portion, the coaxial terminal receiving openings being configured to receive the free ends of the coaxial terminals, alignment members extending from the second wall of the plate portion in a direction away from the first wall, the alignment members positioned proximate the coaxial terminal receiving openings;

the at least one alignment member receiving recess having a first alignment member receiving recess and a second alignment member receiving recess.

wherein the terminal alignment device is movable between a first position in which the plate portion is spaced from the mating surface of the housing to a second position in which the plate portion is positioned proximate to the mating portion.

9. The electrical connector as recited in claim 8, wherein the first alignment member receiving recesses have retaining shoulders positioned therein.

10. The electrical connector as recited in claim 9, wherein first projections extend from the first wall of the plate portion in a direction away from the second wall, the first projections are provided at either end of the plate portions, a resilient latch is provided proximate each first projection, the resilient latch has a latching projection provided at a free end thereof, the first projections are positioned in the first alignment member receiving recesses.

11. The electrical connector as recited in claim 9, wherein second projections extend from the first wall of the plate portion in a direction away from the second wall, the second projections are provided on either side of the plate portion, the second projections are positioned in the second alignment member receiving recesses.

12. The electrical connector as recited in claim 10, wherein alignment posts extend from the mating face, the alignment posts are positioned in alignment openings which extend through the plate portion of the terminal alignment device.

13. An electrical connector assembly comprising:

a first connector, the first connector comprising:

a first housing having a first mating surface;

first coaxial terminals having free ends which are spaced from the first mating surface;

a terminal alignment device having a planar plate portion having a first wall and an oppositely facing second wall, a plurality of first coaxial terminal receiving openings extending through the plate portion, coax alignment members extending from the second wall of the plate portion in a direction away from the first wall, the coax alignment members positioned proximate the first coaxial terminal receiving openings;

a second connector, the second connector comprising:

a second housing having a second mating surface;

second coaxial terminals;

a terminal position assurance member provided proximate the second mating face, the terminal position assurance member having coax alignment member receiving recesses positioned proximate second coaxial terminal receiving openings, the coax alignment member receiving recesses are positioned to cooperate with the coax alignment members of the plate portion of the alignment device;

wherein as the second connector is mated to the first connector, the terminal alignment device is movable between a first position in which the plate portion is spaced from the mating surface of the housing to a second position in which the plate portion is positioned proximate to the mating portion.

14. The electrical connector assembly as recited in claim 13, wherein the terminal position assurance member has a second alignment member receiving recess, the terminal alignment device has a plate portion alignment member, the second alignment member receiving recess is configured to cooperate with the plate portion alignment member as the second connector is mated to the first connector.

15. The electrical connector assembly as recited in claim 13, wherein positioning shoulders extend from the terminal position assurance member, the positioning shoulders engage ends of the second coaxial terminals to retain the second coaxial terminals in position centered in the second coaxial terminal receiving openings.

16. The electrical connector assembly as recited in claim 15, wherein the positioning shoulders have lead in surfaces.

17. The electrical connector assembly as recited in claim 13, wherein resilient arms receiving recesses are spaced about the periphery of the terminal position assurance member, resilient arms are spaced about the periphery of the plate portion of the alignment device, the resilient arms extend from the second wall of the plate portion in a direction away from the first wall, the resilient arms receiving recesses cooperate with the resilient arms of the plate portion as the first connector and the second connector are moved into engagement.

* * * * *